US008297612B2

(12) United States Patent
Chapman et al.

(10) Patent No.: US 8,297,612 B2
(45) Date of Patent: Oct. 30, 2012

(54) APPARATUS FOR DETECTING MEDIA EDGES IN A MEDIA INPUT TRAY

(75) Inventors: Danny Keith Chapman, Sadieville, KY (US); Richard Winston Thomas, Lexington, KY (US)

(73) Assignee: Lexmark International Inc., Lexington, KY (US)

( * ) Notice: Subject to any disclaimer, the term of this patent is extended or adjusted under 35 U.S.C. 154(b) by 51 days.

(21) Appl. No.: 12/816,139

(22) Filed: Jun. 15, 2010

(65) Prior Publication Data

US 2011/0304093 A1 Dec. 15, 2011

(51) Int. Cl.
*B65H 1/18* (2006.01)
*B65H 7/08* (2006.01)

(52) U.S. Cl. ..... 271/38; 271/110

(58) Field of Classification Search ..... 271/38, 271/110

See application file for complete search history.

(56) References Cited

U.S. PATENT DOCUMENTS

2006/0140694 A1* 6/2006 Yano ..... 399/393
2007/0020015 A1* 1/2007 Dan ..... 400/625

* cited by examiner

*Primary Examiner* — David H Bollinger
(74) *Attorney, Agent, or Firm* — John Victor Pezdek

(57) ABSTRACT

A media picking device for an image forming apparatus having a sensing mechanism for detecting the leading and trailing edge of a sheet of media being picked from a media input tray. The device includes a pick mechanism for picking the topmost media sheet; and a sensing mechanism including a sensor and a flag positioned adjacent the pick tire and moveable between at least two positions, the flag having a first end contacting the surface of a picked sheet; the flag moving from a first position to a second position when the leading edge of the picked sheet passes by and moving from the second position to the first position when the trailing edge of the picked sheet passes by. The sensing mechanism providing an output signal corresponding to the movement of the flag. The sensor is one of a photointerrupter, a proximity sensor, a potentiometer, and a switch.

18 Claims, 11 Drawing Sheets

APPARATUS FOR DETECTING MEDIA EDGES IN A MEDIA INPUT TRAY

BACKGROUND

1. Field of the Invention

The present invention relates generally to image forming devices and particularly to media pick mechanism. More specifically, the present invention discloses a media sensing apparatus to detect a leading edge and a trailing edge of a media sheet at the pick point of the media sheet.

2. Description of the Related Art

Most image forming devices have a media picking mechanism that separates and feeds media sheets from a media stack in a media input tray into a main media path. The media stack and the picking device continually move relative to each other so as to keep the media picking mechanism in contact with a topmost media sheet. There are many types of media picking mechanisms, most of which rely upon certain assumptions regarding the general characteristics of friction between the mechanical components of the auto compensator mechanism and the media sheet. If the design assumptions are met, then only a single top most media sheet is separated from the media stack and fed into the system. However, if these assumptions are not satisfied, certain pick and feed errors can result.

The most common pick and feed problems are:

1) Fail to feed errors (FF), where pick tires slip on the media sheet, and the media sheet either fails to move, or does not move far enough to be fed into the main media path;

2) Double or multi-feed errors (DF), where more than one media sheet is fed because subsequent media sheets stick together;

3) Shingle feed errors, where more than one sheet is fed but due to some overlap, the sheets are shingled but appear as one piece of sheet.

While the media picking mechanism can be designed to minimize the frequency at which the above mentioned errors occur under nominal operating conditions, the mechanism will always be susceptible to these types of errors due to a large range of variables. Variables such as media type, media weight, media texture, customer loading conditions, environmental effects, wear of the mechanism and other unexpected variations can affect the reliability of the mechanism, and therefore, some feed issues are inevitable. While there are many design approaches used to address these problems (auto compensating arms, dual friction separators, corner bucklers, etc.), it would be cost prohibitive to design a mechanism that could handle every combination of such a wide range of variables. Common designs work around a nominal center point and allow for as much tolerance as possible to address these variations. This mandates that the design should have a method to deal with the outlying conditions that the design is not intended to accommodate. In addition to these variables, there could be an unexpected scenario when a user may load media that is either shorter or longer than expected.

Generally, image forming apparatus have sensors at stationary locations in the media path to monitor the movement of the media sheets and are located downstream from a pick point of the media picking mechanism. In the event, one of the pre-described errors occur, the image forming apparatus is configured to detect an unexpected transition at one or more of these sensors, and the image forming apparatus is then forced to stop the media sheet in the media path and post a "media jam" because the image forming apparatus cannot accurately predict the condition of the media sheet. While the common jam scenarios mentioned above do not create a condition where the media sheet is obstructed, the image forming apparatus does not have a means to detect this and therefore stops the media sheet. These "obstructed" jam scenarios require the media sheet to be cleared by the user. During the jam removal, there is opportunity for the user to damage the media sheet while clearing the media path by grabbing and pulling the media sheet out, possibly ripping the sheet, wrinkling it, or otherwise making it unsuitable for future use. The user may then likely throw the media sheet in the trash, resulting in higher usage cost to them. Further, in order to gain access to the media path, most of the image forming apparatus requires the user to open covers/doors and remove components, such as a print cartridge. This increases the chances that damage can occur to either the machine or the print cartridge, resulting to further increased expense and inconvenience. Users, who are unable to perform these actions, may additionally require a service call and/or warranty action.

To reduce these problems and create a better customer experience, an inexpensive means of detecting a media sheet at the pick point before the media sheet enters the media path is needed so that the machine firmware can make better decisions regarding the movement of the media sheet, thereby avoiding unnecessary jam conditions caused by undesired media sheet behavior.

Given the foregoing, it would be desirable to be able to sense the leading and trailing edges of a media sheet being picked while it is still in the media input tray such that the image forming device firmware can detect a leading edge and a trailing edge of each media sheet at or adjacent to the pick point itself rather than waiting for the media sheet to be fed into the media path and then being sensed. This enables the image forming device to prevent media jam conditions by avoiding scenarios that can occur when the image forming apparatus picks the media sheet and then has to wait to sense the media sheet until it is in the media path.

SUMMARY OF THE INVENTION

A media picking device for a media input tray of an image forming apparatus, the media picking device rotatable within the media input tray, the media picking device comprising a media pick mechanism having a rotatable pick member therein for picking a media sheet; and a media sensor mounted on the media pick mechanism adjacent a media sheet pick point having an output signal change when a leading edge of the media sheet being picked passes by and has another output signal change when a trailing edge of the media sheet being picked passes by.

In another form the media picking device comprises an arm engaging a stack of media sheets in the media input tray by being rotatable into the media tray; a pick shaft rotatably connected to one end of the arm; a first pick tire rotatably disposed at a first end of the pick shaft and a second pick tire rotatably disposed at a second end of the pick shaft, the first and second pick tires contacting and picking a topmost media sheet in the media input tray; and a sensing mechanism comprising a photointerrupter disposed at one end of the arm, the photointerrupter including a pair of opposed arms and a light beam passing between the opposed arms; and a flag pivotable about the pick shaft, the flag moving from a first position to a second position when the leading edge of the media sheet being picked passes by and moving from the second position to the first position when the trailing edge of the media sheet being picked passes by, the flag having a first end for contacting the media sheet being picked and a blocking member at a second end, the blocking member of the flag entering and exiting the opposed arms as the flag moves between the first and second positions, wherein the sensing mechanism provides an output signal representative of the leading and trailing edges of the media sheet being picked as the flag moves from the first position to the second position and from the second position to the first position.

In another form there is provided a device to move media sheets within an image forming apparatus. The device comprises an arm rotatably driven from the image forming apparatus and positioned to engage a stack of media sheets in a media input tray; a pick shaft rotatably connected to one end of the arm; a sensing mechanism comprising a photointerrupter disposed at one end of the arm, the photointerrupter having a light emitting element and a light receiving element and actuated by a light beam traveling from the light emitting element to the light receiving element, and a member pivotable about the pick shaft and interrupting the light beam when the member is not in contact with a media sheet being picked.

In a still further form a media sensing mechanism mountable on a media picking device for an image forming apparatus comprises a sensor mountable adjacent a pick end of the media picking device in a media input tray; and a flag mountable on a pick shaft of the media picking device and moveable between at least two positions, the flag having a first end for contacting the surface of a media sheet being picked adjacent the picking point; the flag moving from a first position to a second position when the leading edge of the media sheet being picked passes by and moving from the second position to the first position when the trailing edge of the media sheet being picked passes by, wherein the sensor senses the movement of the flag when the flag moves between the first and second positions with the sensing mechanism providing an output signal corresponding to the movement of the flag.

The sensors and sensing mechanisms of the various forms detect the leading and trailing edge of a sheet of media being picked while in a media input tray rather than such edge detection later occurring when the sheet of media has been fed into the media path of an image forming device.

In the various forms the sensor may comprise a photointerrupter. In some embodiments, a blocking member of the flag interrupts the light beam at the first position when the first end of the flag is not in contact with the media sheet. In another embodiment, the blocking member of the flag allows the light beam to pass between the opposed arms at the second position until the trailing edge of the media sheet clears the first end of the flag. In yet another embodiment, the flag rotates through an angle of between about 20 and about 70 degrees or between about 40 degrees to about 60 degrees when the leading edge of the media sheet contacts the first end of the flag.

BRIEF DESCRIPTION OF THE DRAWINGS

The above-mentioned and other features and advantages of the various embodiments of the invention, and the manner of attaining them, will become more apparent and will be better understood by reference to the accompanying drawings, wherein.

DETAILED DESCRIPTION

Figure 1:
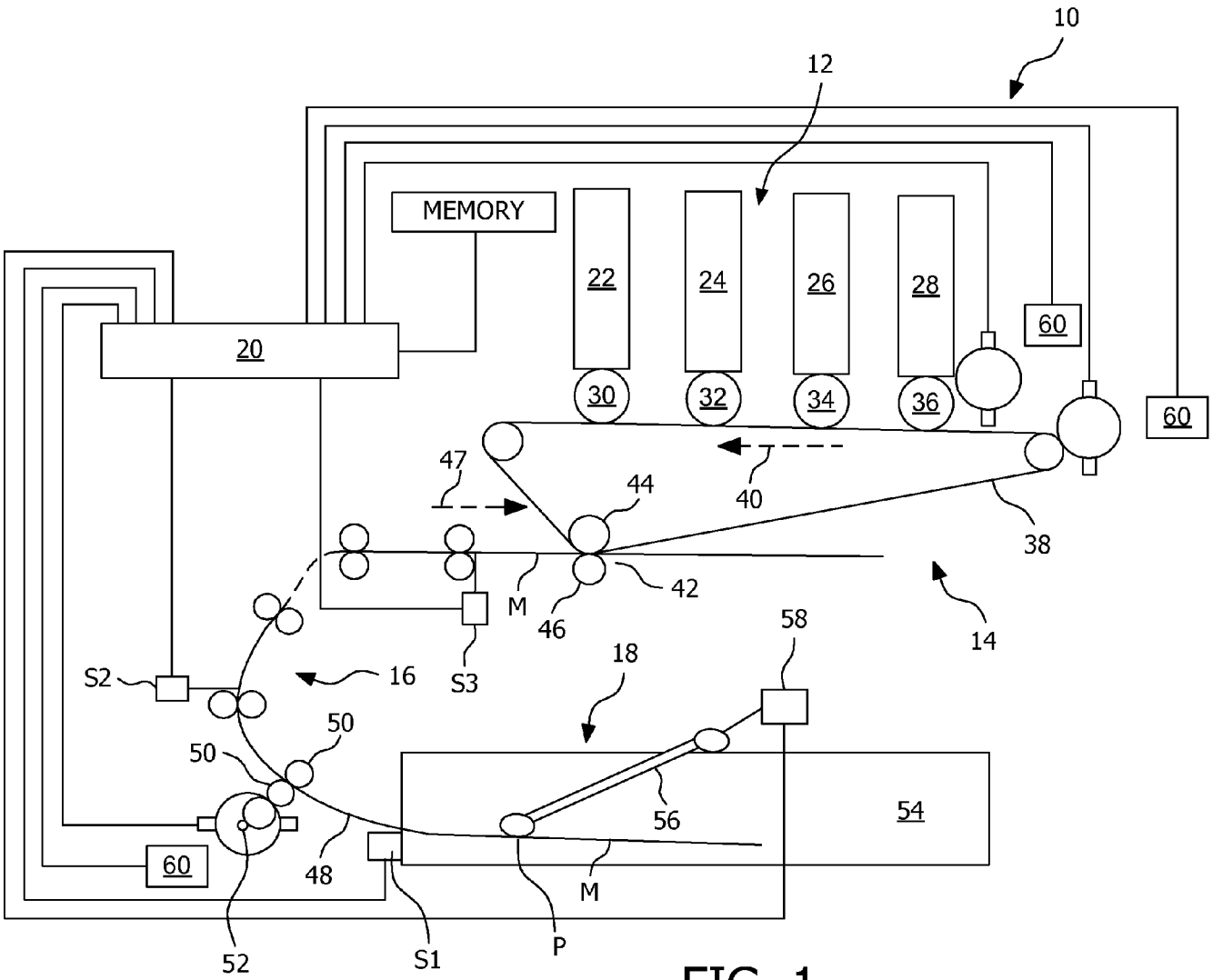
FIG. 1 is a schematic view of one embodiment of an image forming apparatus according to the present invention.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Reference will now be made in detail to the exemplary embodiment(s) of the present invention, as illustrated in the accompanying drawings. Whenever possible, the same reference numerals will be used throughout the drawings to refer to the same or like parts. Also the terms "autocompensator mechanism," "pick mechanism," and "media picking device" are used interchangeably within the following description.

FIG. 1 schematically illustrates an image forming device 10 that includes an image forming section 12, an intermediate section 14, a media moving section 16, an input section 18, and a controller 20 according to the present invention. The image forming section 12 includes a plurality of toner cartridges 22, 24, 26, and 28, each having corresponding photoconductive drums 30, 32, 34, and 36. Each of the toner cartridges 22, 24, 26, and 28 has a similar construction and is distinguished by a toner color contained therein, typically, black, magenta, cyan and yellow. Individual toned images are formed corresponding to their respective color and are combined in a layered fashion to create a final multicolored image. Each of the photoconductive drums 30, 32, 34, and 36 continuously and uniformly rotate past a laser scan unit (not shown). Each of photoconductive drums 30, 32, 34, and 36 has a smooth electrostatically charged surface that is scanned by a laser beam from a laser scan unit forming a latent image representing the image to be printed. After receiving the latent image, the photoconductive drums 30, 32, 34, and 36 rotate past respective toner developing areas each having a toner sump and a developer roller for uniformly transferring toner to respective photoconductive drums 30, 32, 34, and 36. The toner is a fine powder usually composed of plastic granules that are attracted to the electrostatic latent image formed on the surface of the assembly of the photoconductive drums 30, 32, 34, and 36.

The intermediate section 14 includes an intermediate transfer medium (ITM) belt 38 for receiving the toner images from each of the photoconductor drum surfaces. As shown in FIG. 1, the ITM belt 38 is an endless belt that extends around a series of rollers adjacent to the photoconductive drums 30, 32, 34, and 36. The ITM belt moves in a direction indicated by the arrow 40. The ITM belt 38 and the photoconductive drums 30, 32, 34, and 36, are synchronized providing for the toned image from each photoconductive drum to precisely align in an overlapping arrangement. The ITM belt 38 moves the toned image towards a second transfer point 42 where the toned images are transferred to a media sheet M moving in a direction indicated by the arrow 47. A pair of rollers 44 and 46 form a transfer nip 42 where the toner images are transferred from the ITM belt 38 to the media sheet M.

Media moving section 16 comprises a media path 48 within the image forming device having a series of nip rollers 50 spaced along it and rotated to control the speed and position of each media sheet M as it moves from the input section 18 to the second transfer point 42. One or more sensors S1, S2, S3, etc., are placed along the media path 48 to determine a current position of the media sheet M. The sensors may be optical sensors that detect a leading edge L and/or a trailing edge T of the media sheet M when passing the respective sensor locations. The nip rollers 50 are operated by one or more motors 52, which control the speed of the media sheet M moving along the media path 48. The range of speeds of the nip rollers 50 can be adjusted by the controller 20. In one embodiment, a first section extends between sensor S1 and sensor S2 and a second section extends between sensor S2 and the second transfer point 42. In some cases, the media sheets M are not sensed until the media sheet reaches sensor S2. The rate of movement of the media sheet M at each of the sections can be adjusted as necessary to properly intercept the toned image at the second transfer point 42. These sensors S1, S2, and S3 are typically located downstream from the pick point P in a media input tray.

Input section 18 comprises an media input tray 54 for holding a stack of media sheets and an auto compensator mechanism or pick mechanism 56 for picking a topmost media sheet M from the media feed stack and feeding it towards the media moving section 16. A drive assembly 58 is controlled by the controller 20 to activate the pick mechanism 56. At a designated time, the auto compensator mechanism 56 receives a command from the controller 20 to pick the top most media sheet M. The media sheet M moves through the beginning of the media path 48 and its leading edge eventually trips a media path sensor S1. The controller 20 immediately begins tracking incrementally the position of the media sheet M by monitoring the feedback of encoder 60 associated with media path motor 52. The remaining distance of the media sheet M from the media path sensor S1 to the second transfer point 42 can be calculated from the known distance between S1 and second transfer point 42 and feedback from the encoder 60.

Figure 2:
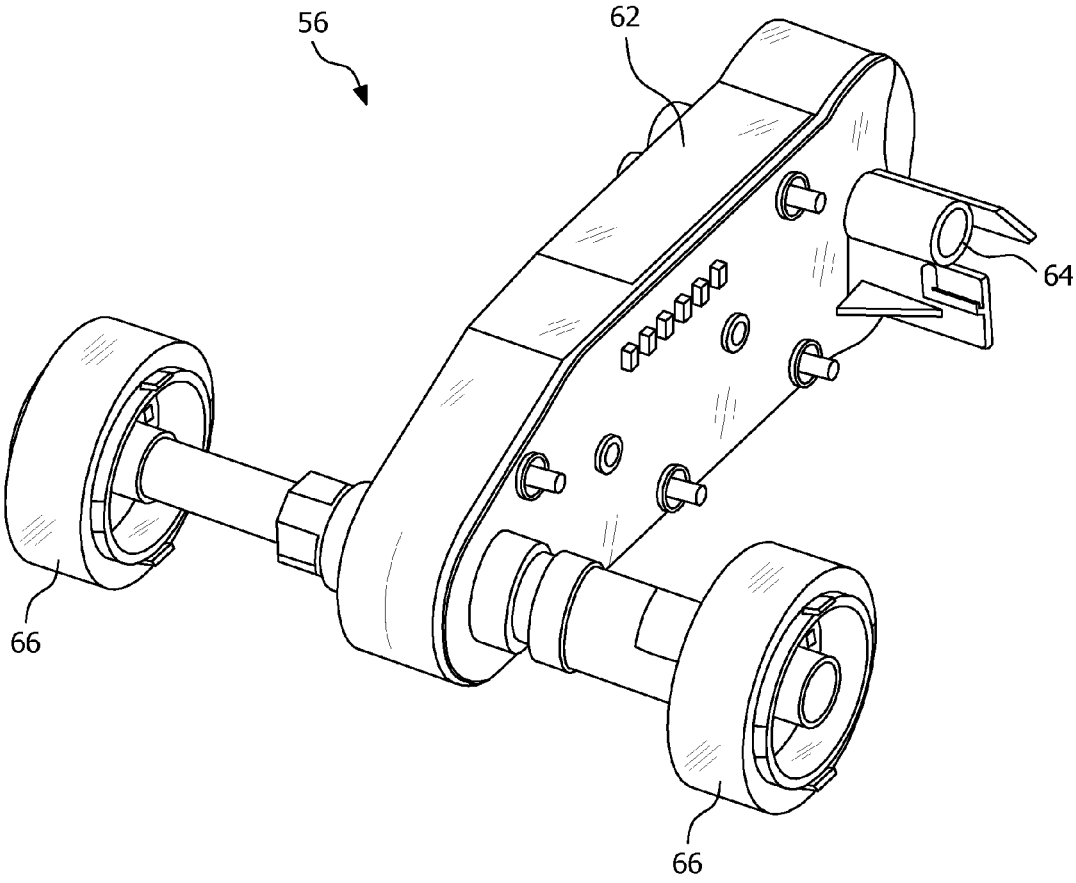
FIG. 2 (PRIOR ART)
FIG. 2 is a perspective view of a standard auto compensator pick assembly according to a prior art system.

FIG. 2 illustrates an auto compensator mechanism or pick mechanism 56 according to a prior art system within the input section 18. The auto compensator mechanism 56 includes an arm 62 pivotally mounted to the image forming device 10 at drive shaft 64 which is connected to drive train 58 that is controlled by controller 20. The arm 62 is positioned over the media input tray 54 (FIG. 1) with pick tires 66 contacting the topmost media sheet M. A drive assembly within arm 62 driven by drive shaft 64 rotates the pick tires 66 to move the topmost media sheet M from the media input tray 54 into the media path 48.

The auto compensator mechanism 56 is widely used in many laser printers and, like most, is susceptible to certain feed errors as described earlier. The pick tires 66 rest on the top media sheet M of the media stack. During media feeding, the pick tires 66 are in contact with the top most media sheet M in the media stack. The height of the media stack in the media input tray 54 decreases with each media sheet being picked. The pick tires 66 rotate through various positions as each media sheet is fed and the media stack height decreases. For a common stationary sensor in the media path 48, this would lead to variable pick-to-sensor distances, depending on the media stack height. As the height of media stack decreases, the pick point of the pick tires 66 moves closer to the bottom of the media stack, thereby increasing the distance from the pick point P to the sensing point of the earliest sensor. Usually, a compromise is achieved to these two conflicting situations by placing a stationary sensor as close as possible to the exit of the media input tray 54, and hence foregoes the ability of the stationary sensor to detect at the pick point. But this also compromises the ability to prevent the aforementioned pick and feed problems because the sensing location can often be several inches beyond the pick point, commonly as much as 5 to 6 inches beyond the pick point P.

Figure 3:
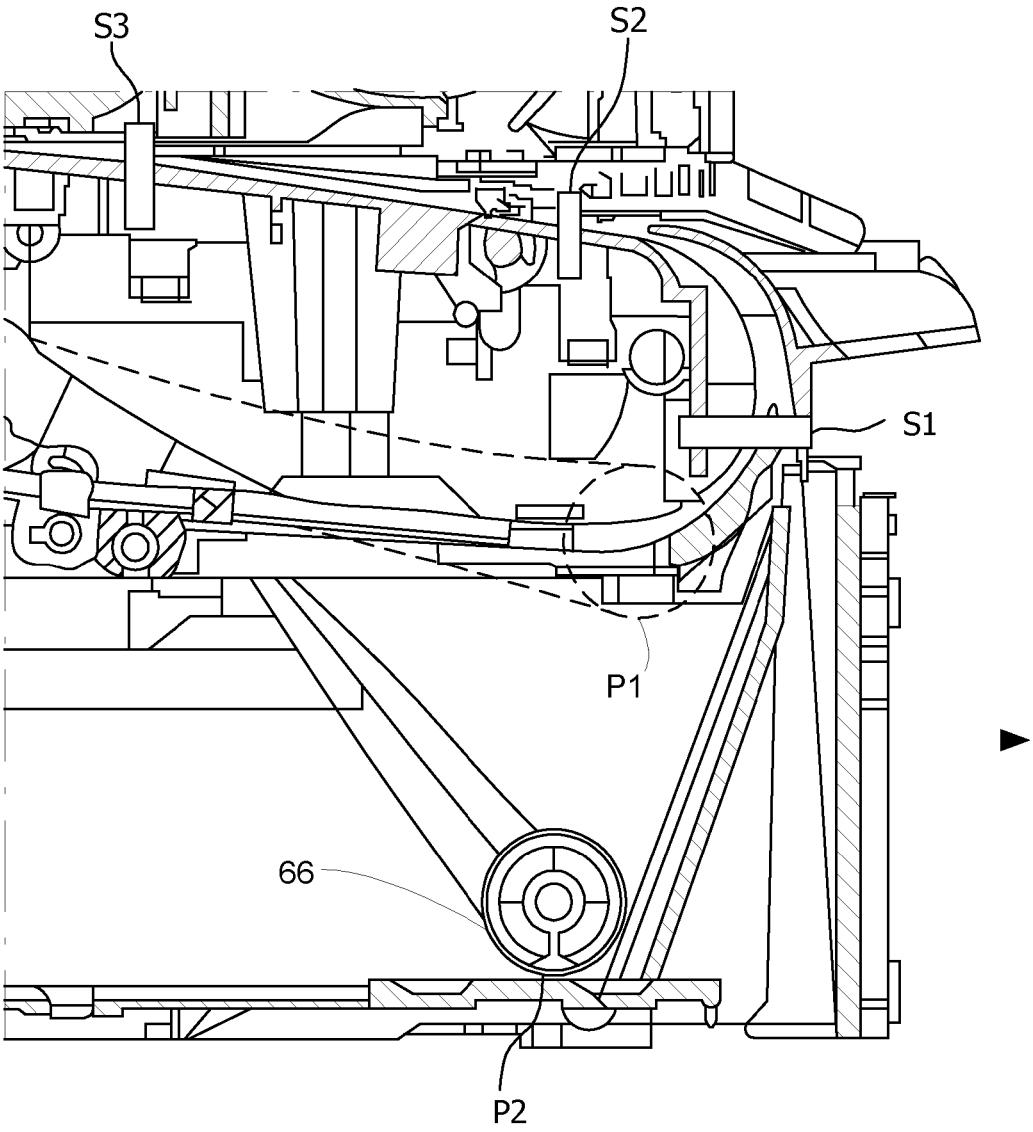
FIG. 3 (PRIOR ART)
FIG. 3 is a partial cross-section view of an earliest sensing location according to a prior art system.

FIG. 3 shows stationary sensors S1, S2, and S3 in a media path according to a prior art system. As the media stack decreases, the pick point of the pick tires 66 rotate closer to the bottom of the media input tray 54, from its original position P1 (as shown in dotted lines assuming a filled media input tray 54) to position P2, further increasing the distance from the pick point to the sense point S1. Since the pick point P of the pick tires 66 moves, placing a stationary sensor S1 close to the pick point is extremely difficult, as the location of the topmost sheet is not fixed because of variation in the media stack height. Further, the sensor must be placed in a position that does not interfere with the removal of the media input tray 54, yet it needs to be placed close enough to provide for quick sensing. Since there is a desire to have fast printing throughput, the picking of a subsequent media sheet must be initiated before the trailing edge T of the top most sheet M is detected at this sensor.

Figure 4:
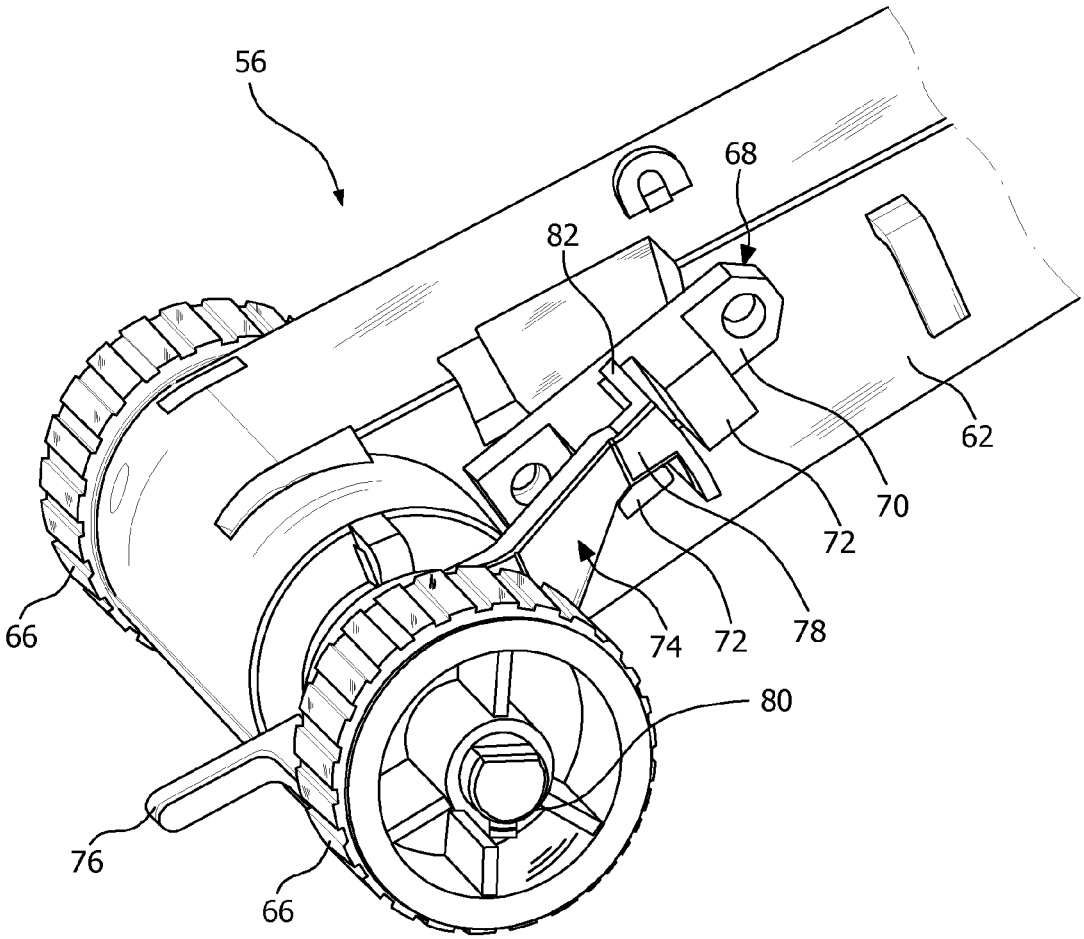
FIG. 4 is a perspective view of one embodiment of a sensing mechanism attached to an auto compensator mechanism in its original position according to the present invention.

FIG. 4 illustrates a sensing mechanism 68 attached to arm 62 of the auto compensator mechanism or pick mechanism 56, according to one embodiment of the present invention. The sensing mechanism 68 includes a photointerrupter 70 comprising a pair of opposed arms 72, and an infrared emitter 86 (FIG. 5) on one of the opposed arms 72 and an infrared detector (not shown) on the other of the opposed arms 72. The infrared emitter 86 emits a beam of infrared light between the pair of opposed arms 72 and due to the infrared light, the sensing mechanism 68 can detect when an object passes between the pair of opposed arms 72.

A flag 74 having a first end 76 and a second end 78 pivots around a pick shaft 80. The second end 78 of the flag 74 includes a blocking member 82 that is configured to pass between the pair of opposed arms 72. When between opposed arms 72, the blocking member 82 interrupts the beam of infrared light passing between the opposed arms 72 of the sensing mechanism 68. The flag 74 remains in this first position when the flag 74 is not in contact with the media sheet M indicating that there is no movement of the media sheet M.

Figure 5:
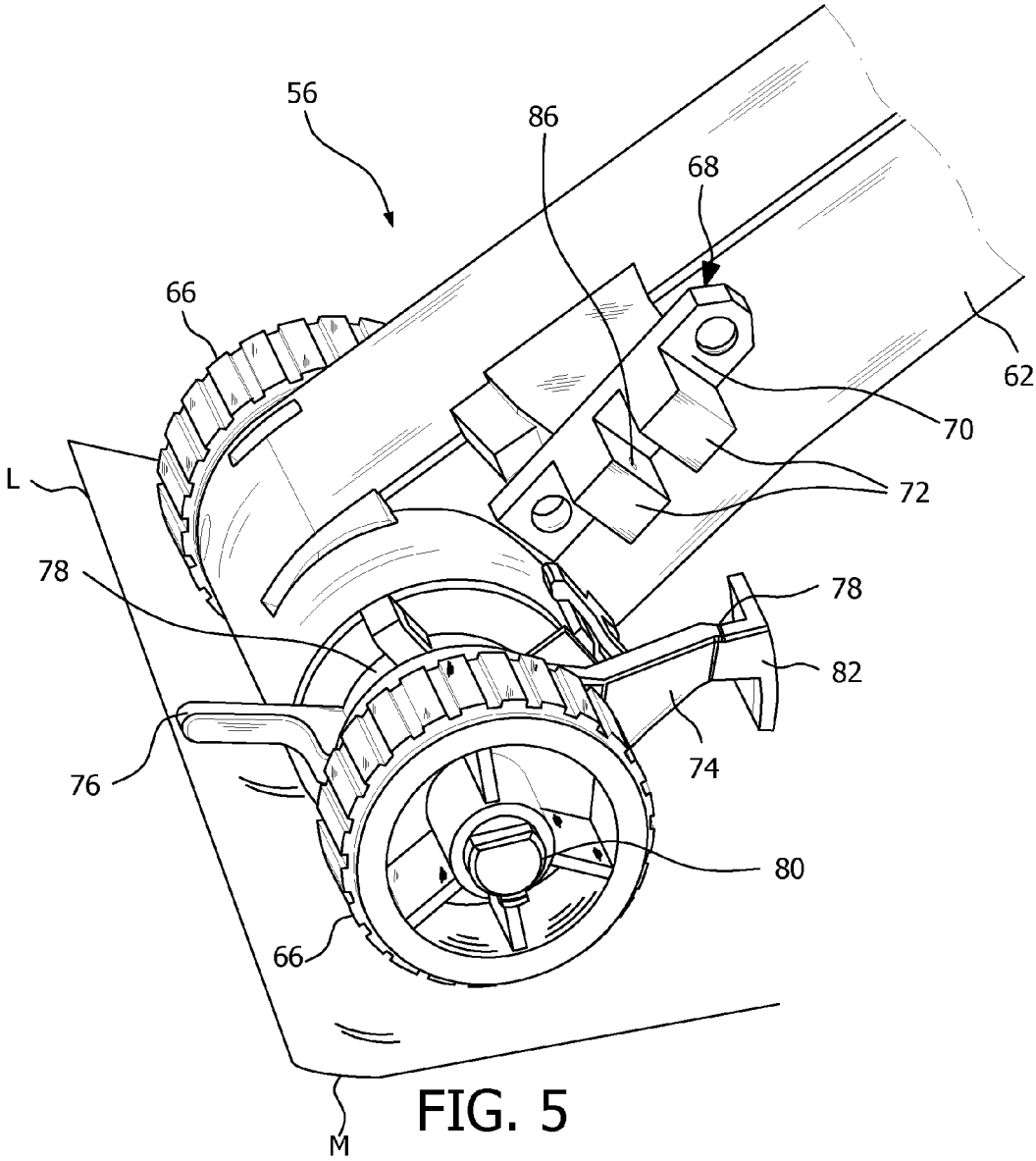
FIG. 5 is a perspective view of one embodiment of a sensing mechanism 15 attached to the auto compensator mechanism in another position according to the present invention.

FIG. 5 illustrates the position of the flag 74 when the leading edge L of the media sheet M comes into contact with the first end 76 of the flag 74. When a print job is received, the pick tires 66 of the auto compensator mechanism 56 pick the media sheet M and the media sheet M is separated from the media stack in the media input tray 54 causing the leading edge L of the media sheet M to contact the first end 76 of the flag 74. Due to the leading edge L of the media sheet M contacting the first end 76 of the flag 74, the flag 74 rotates about a pivot point provided by pick shaft 80 moving to a second position causing a change of state or transition in the output signal provided by the sensing mechanism 68. As the media sheet M continues to move, the flag 74 stays in the second position until the trailing edge T of the media sheet M clears the first end 76 of the flag 74 and returns to the first positions. Thus during picking, the flag 74 moves between the first and second positions. During the transition mode, i.e., when the first end 76 of the flag 74 contacts the leading edge L of the media sheet M, the flag 74 rotates (clockwise as viewed in FIG. 5) at an angle of between about 20 and about 70 degrees, and more preferably between about 40 and about 60 degrees. Further, the first end 76 of the flag 74 returns to its original position when the trailing edge T of the media sheet M clears the first end 76 of the flag 74.

Due to the rotation caused to the flag 74 when the media sheet M is in contact with the first end 76 of the flag 74, the blocking member 82 changes position and moves out of the opposed arms 72 and thereby causing the beam of infrared light to pass from the infrared emitter 86 in one of the opposed arms 72 to the infrared detector (not shown) in the other of the pair of opposed arms 72. Thus, with the blocking member 82 no longer positioned between the opposed members 72, the output signal from sensing mechanism 68 changes state and is sent to controller 20 in the image forming device 10 indicating that the leading edge L of media sheet M has contacted the flag 74 as the media sheet M travels out of the media input tray 54.

The controller 20 of the image forming apparatus 10 is thus capable of determining if a pick and feed was successful or if any one of the aforementioned pick errors has occurred. The controller 20 also senses the leading edge L and the trailing edge T at expected points of time using the other mentioned sensors as well. For example, if a timer or counter is started when the leading edge L is detected and stopped when the trailing edge T is detected and if the media sheet M is sensed along the media path 48 for a longer than expected time, the controller 20 can more quickly detect that a shingle double feed error has occurred prior to the trailing edge of the media sheet M arriving at one of the typical stationary sensors downstream in the media path 48 (FIG. 1). This allows for the misfed media sheets to be more quickly stopped and more easily corrected as the misfed media sheets have not progressed as far down the media path as in prior art imaging devices. Also, with the sensing mechanism adjacent the picking point, the controller 20 can more quickly determine when a previous media sheet M has exited the media input tray 54 allowing for a smaller inter-page gap between the feeding of two successive media sheets. This allows process speeds in the image forming apparatus 10 to be kept lower while still reaching desired printing throughput. Lower speeds help to reduce wear and tear on the moving components within the system. At the same time, this also reduces the forcing of media sheets being fed into the media path 48 in the event of a media sheet pick/feed problem by allowing the controller 20 to only pick a media sheet M after the controller 20 knows that the previous media sheet M has been properly fed from the media input tray 54. Further, when a fail to feed problem occurs during the media sheet pick process, the sensing mechanism 68 can detect that the media sheet M has not moved because the pick to sense distance is much smaller because the output of the sensing mechanism 68 does not change state within an predetermined amount of time after the controller 20 initiates the picking operation.

Figure 6:
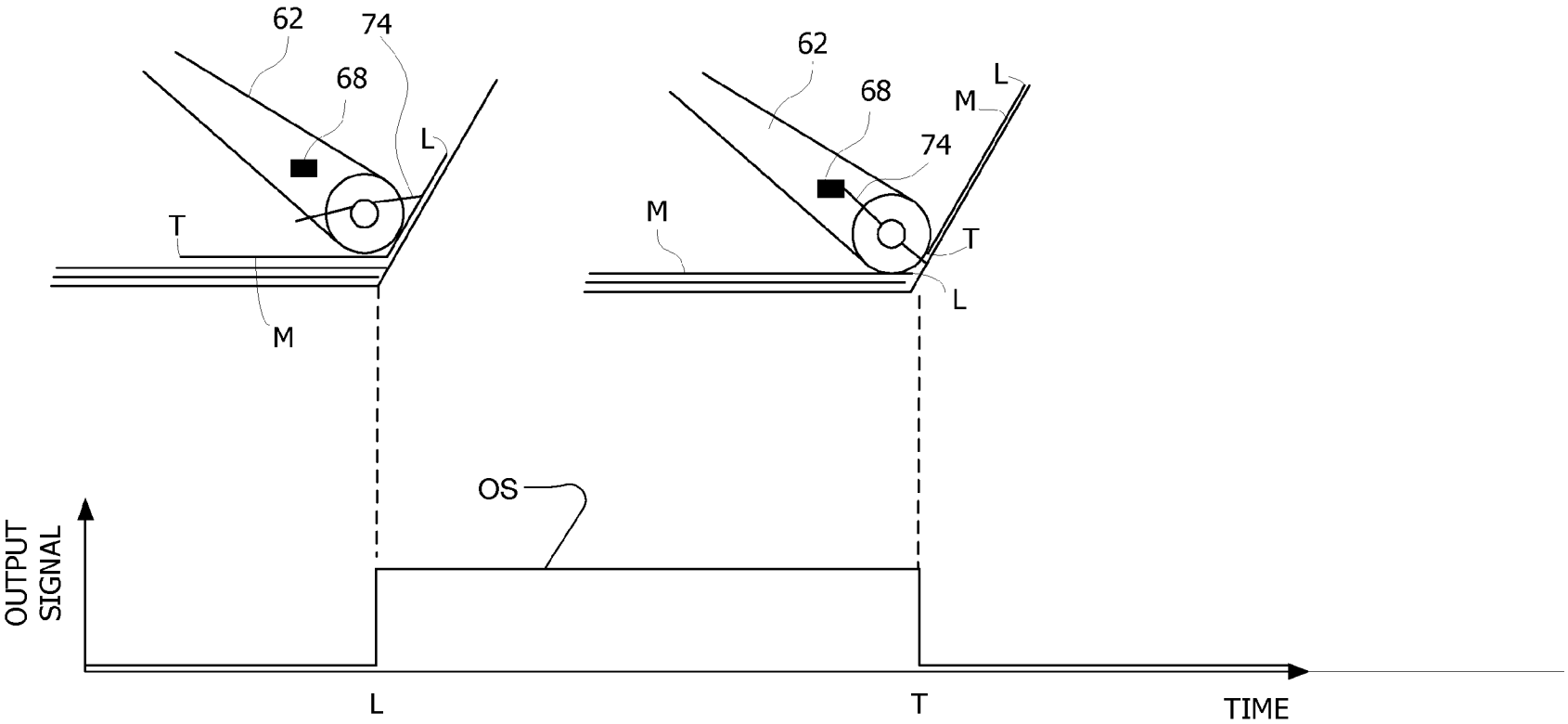
FIG. 6 illustrates an electrical signal generated from one embodiment of a sensor showing media edge detection according to the present invention.

FIG. 6 illustrates the change of state in the output signal OS of the sensing mechanism 68 when the leading edge L of a media sheet M contacts the flag 74 and when the trailing edge T of the media sheet M clears the flag 74. When the leading edge L of the media sheet M hits the flag 74, the flag 74 rotates to a second position and is no longer positioned between the opposed arms 72 (FIG. 4). When the trailing edge T of the media sheet M clears the flag 74, the flag 74 returns to its first position. When the flag 74 is not positioned between the opposed arms 72, the sensing mechanism 68 generates an electrical signal thereby leading to identification of the leading edge L and the trailing edge T of the media sheet M when the output signal OS changes state. While the output signal OS is shown as being continuous between the leading edge L and trailing edge T, other signal forms can be used to sense the change in position of the flag 74. For example a pulse can be sent when the flag changes state at the leading and trailing edges of the media sheet being picked.

Figure 7:
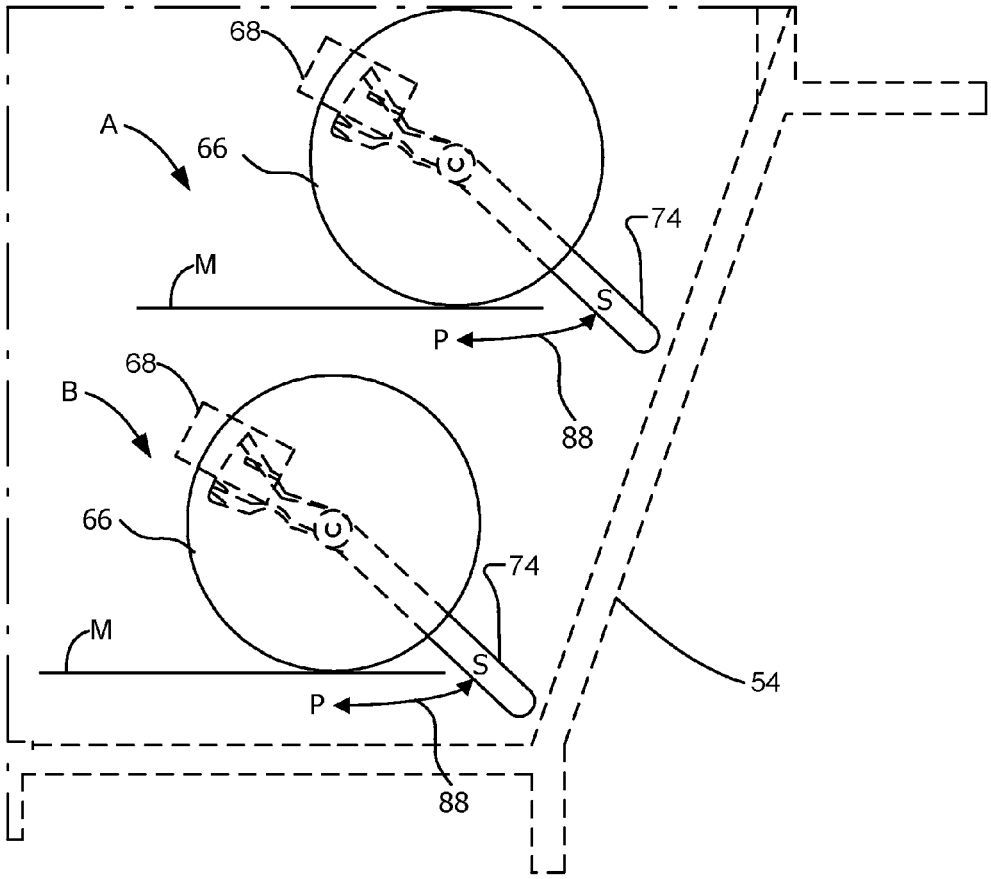
FIG. 7 illustrates pick-to-sense distance between the sensing mechanism and 20 the auto compensator mechanism at two positions A and B representing different media stack heights in the media input tray.

FIG. 7 illustrates two different media stack height positions A and B within the media input tray 54. As media sheets M are feed out of the media input tray 54, the arm 62 rotates downward from position A to position B. As the sensing mechanism 68 is located on the arm 62 of the auto compensator or pick mechanism 56, the sensing mechanism 68 remains as close to the pick point P as possible. This allows the pick to sense (P-S) distance 88 to remain relatively constant throughout the varying media stack heights. By doing this, the controller can detect an edge of the media sheet M adjacent to the pick point P itself, rather than waiting for the media sheet M to be detected by a stationary sensor in the media path 48 (FIG. 1). By sensing the leading edge L and the trailing edge T at the pick point P, the controller 20 determines much sooner if a pick of the topmost media sheet M was successful and also whether a subsequent pick can occur, thus avoiding media sheet jams in the media feed path, as in the prior art.

Figure 8:
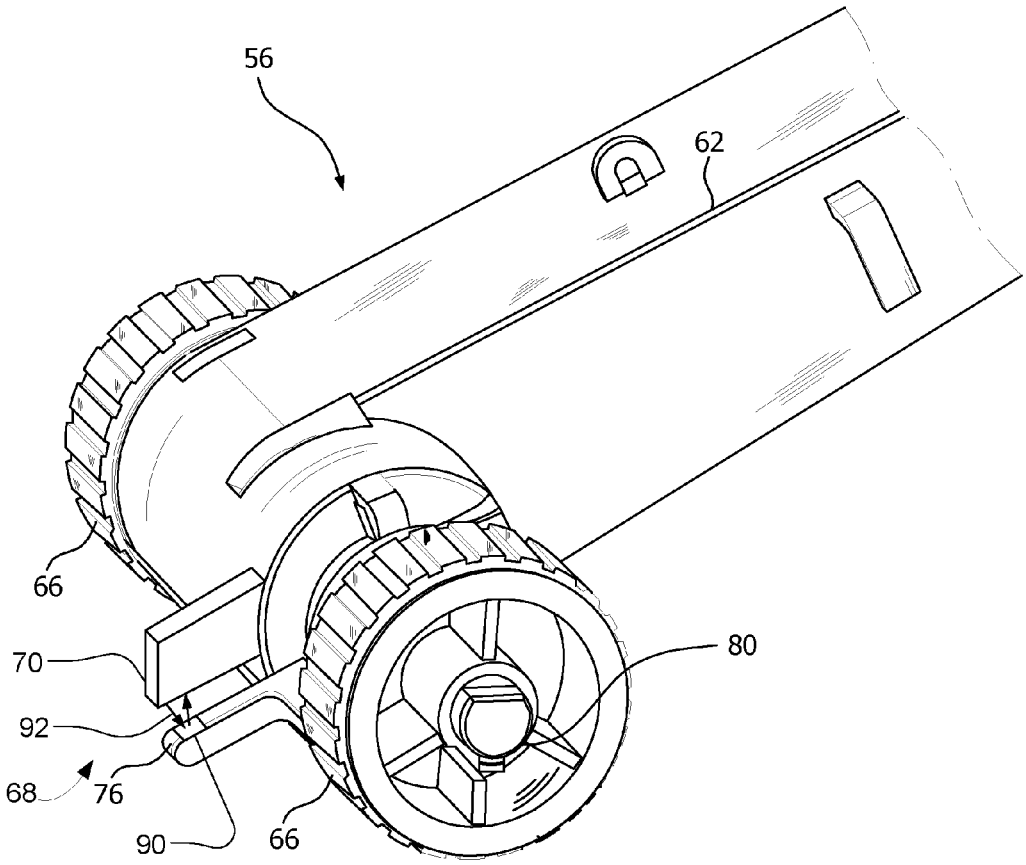
FIG. 8 illustrates an alternate embodiment of the invention wherein the sensor is mounted adjacent the first end of the flag.

Referring now to FIG. 8, shown there is another embodiment of the invention. The sensing mechanism 68 is shown mounted on the distal end of the media picking device 56. The rotatable arm 62 is positioned to engage a stack of media sheets in a media input tray. A rotatable pick shaft 80 is connected to one end of the arm 62. Pick tires 66 are disposed on the pick shaft 88 for contacting and picking a top-most media sheet. The sensing mechanism 68 comprises a sensor 70, such as a photointerrupter having an emitter and receiver, and a flag 74 positioned adjacent the pick tire 66 and pivotable between at least two positions. The flag 74 is shown pivoting about the pick shaft 80 but the flag can also be pivotally mounted on arm 62 using a linkage. The flag 74 has a first end 76 for contacting the surface of a media sheet being picked; and moves from a first position to a second position when the leading edge of the media sheet being picked passes by and moves from the second position to the first position when the trailing edge of the media sheet being picked passes by. As illustrated a reflecting surface 90 is provided on the flag 74 and is used to reflect a light beam 92 from the emitter in sensor 70 to the receiver. When the flag 74 is in the first position, the light beam 92 is not reflected back to the receiver in the sensor 70. When the flag 74 moves to the second position, the light beam 92 is reflected back to the receiver wherein the sensor 70 senses the movement of the flag 74 when the flag 74 moves between the first and second positions with the sensing mechanism 68 providing an output signal corresponding to the movement of the flag 74 and representative of the leading edge L and trailing edge T of the media sheet being picked such as the one illustrated in FIG. 6.

Figure 9:
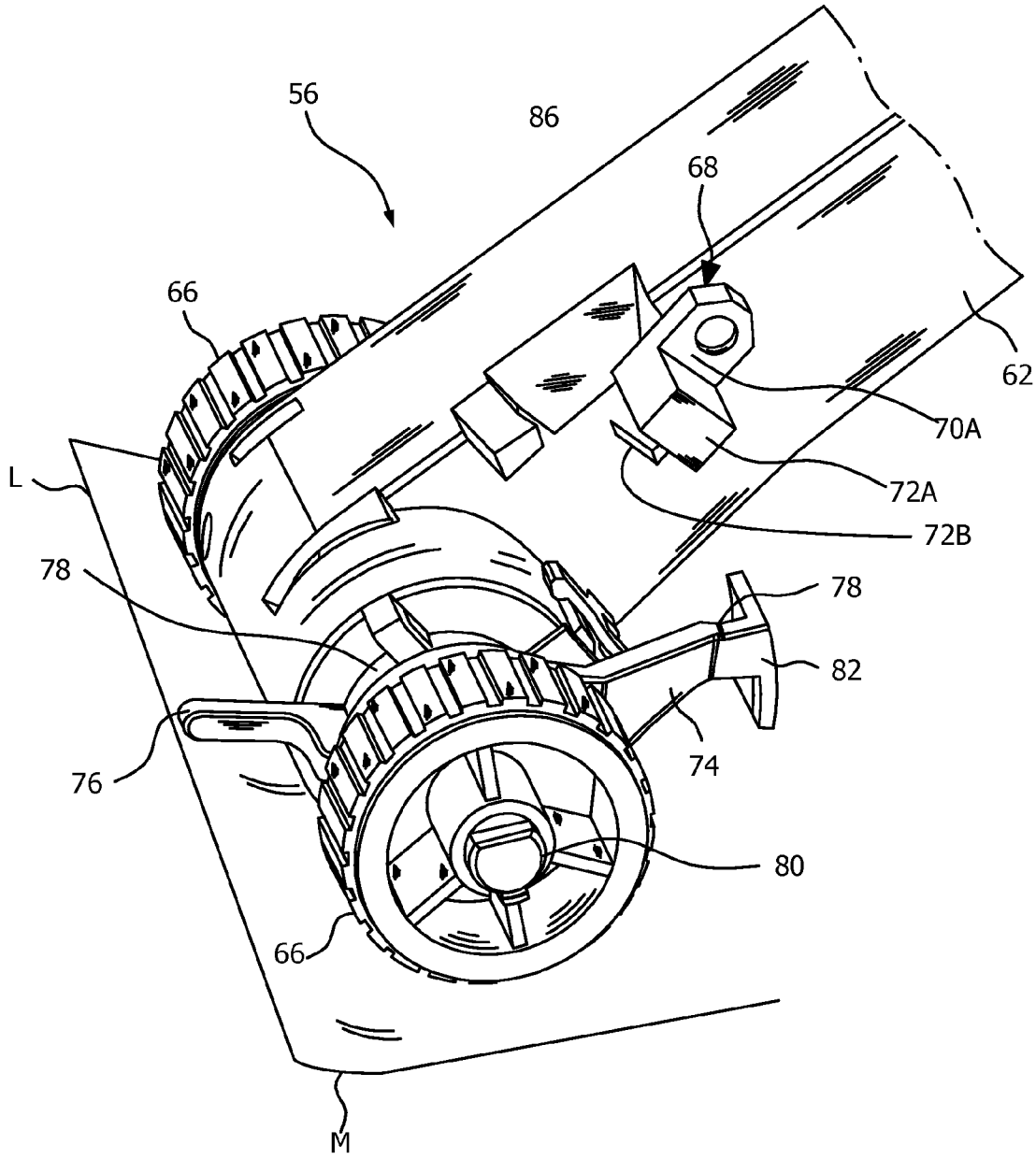
FIG. 9 illustrates an alternate embodiment of the invention wherein the sensor is a switch.
Figure 10:
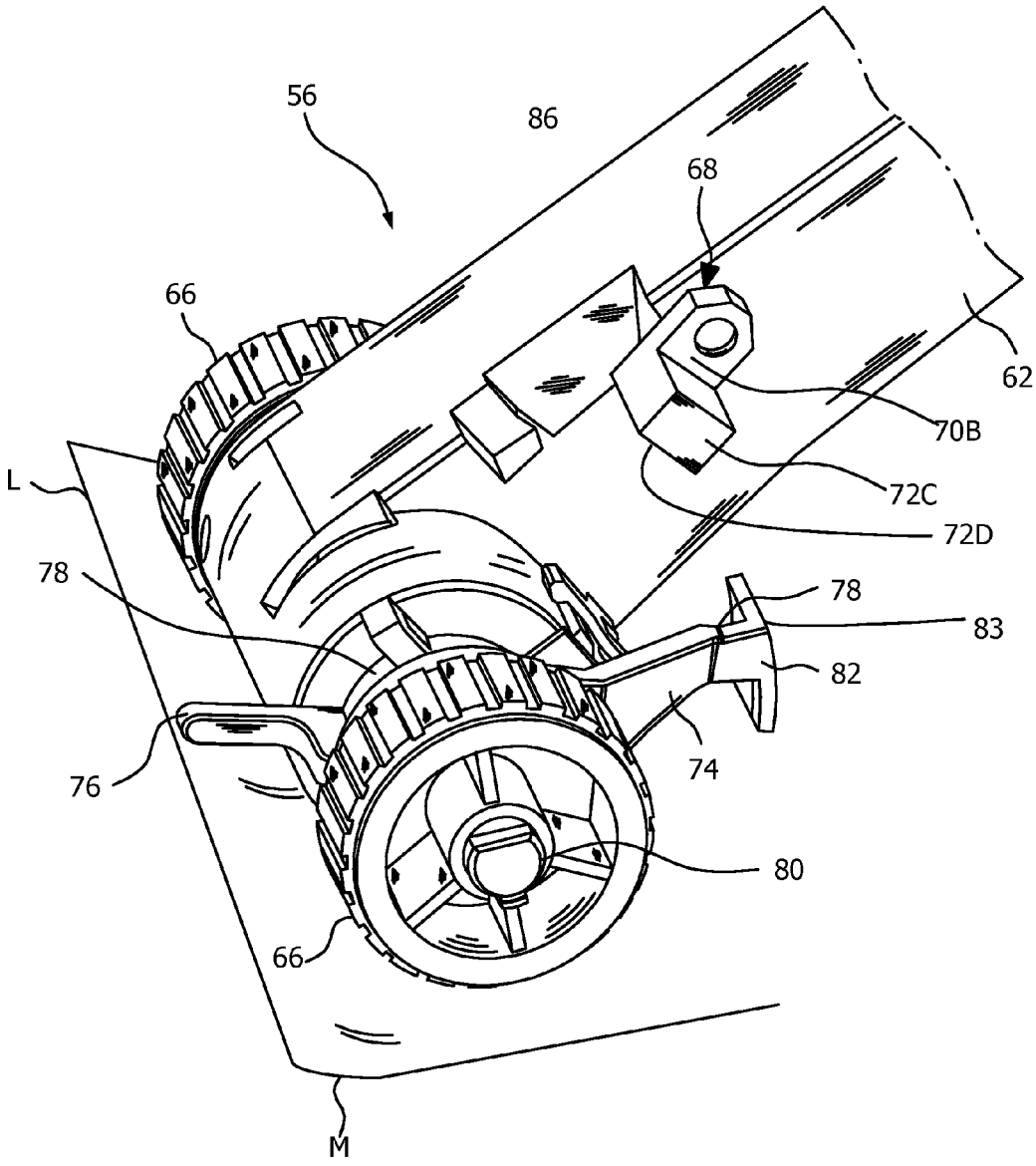
FIG. 10 illustrates an alternate embodiment of the invention wherein the sensor is a proximity sensor.
Figure 11:
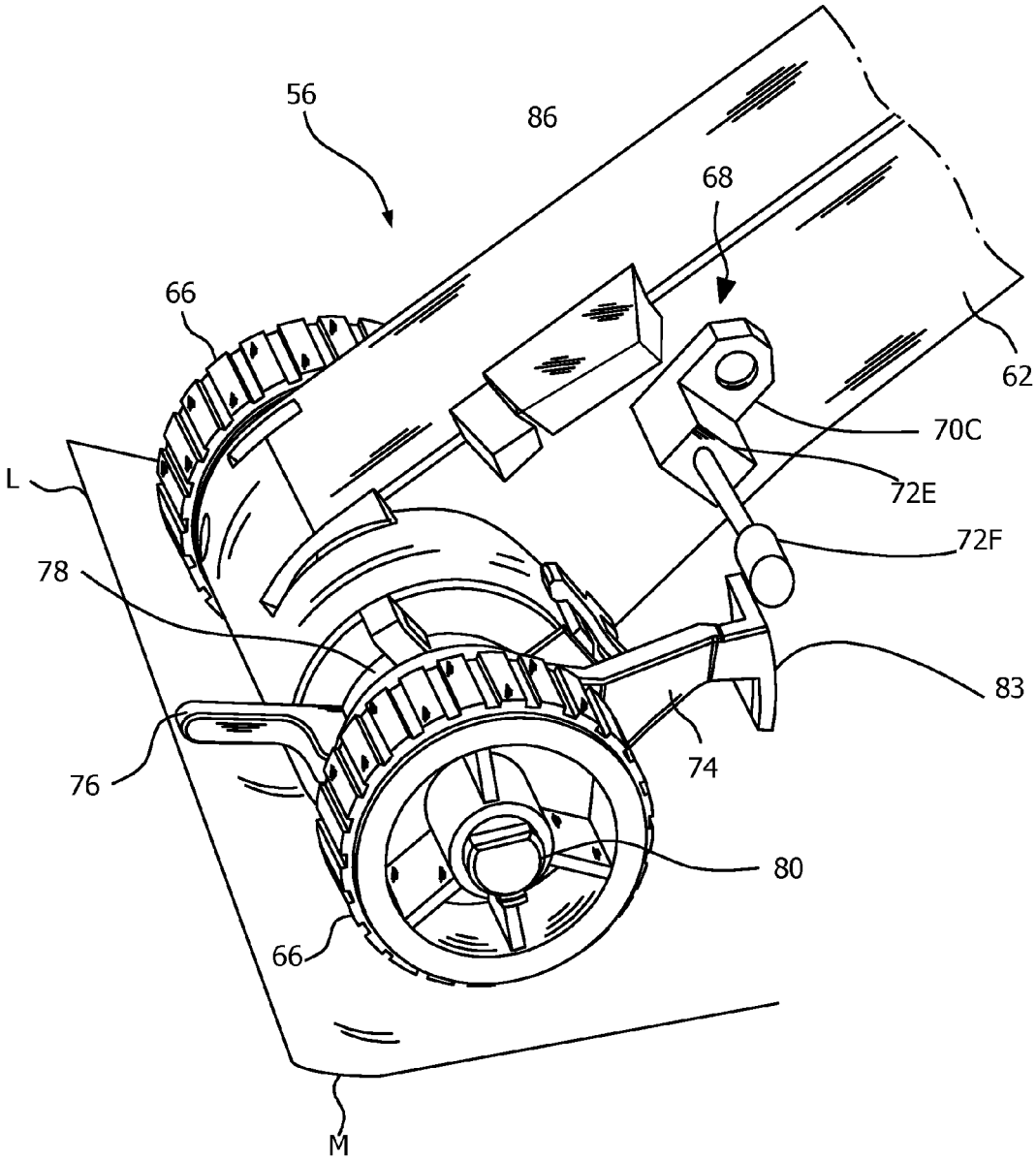
FIG. 11 illustrates an alternate embodiment of the invention wherein the sensor is a potentiometer.

FIGS. 9-11 illustrate alternate embodiments of the sensor 70 used in sensing mechanism 68. FIG. 9 illustrates sensor 70 as a switch 70A having a actuation arm 72B mounted on the body 72A that is moved by the second end 78 of flag 74. FIG. 10 illustrates sensor 70 as a proximity sensor 70B that is actuated when the face 83 of flag 82 is adjacent the face 72D of body 72C of the sensor 70B. FIG. 11 illustrates sensor 70 as a potentiometer 70C having a knob 72F extending from body 72E of potentiometer 70C. The knob 72F is rotated as flag 82 moved between its first and second positions. As is well known, rotation of knob 72F changes the resistance value of the potentiometer 70C. Other means for linking the actuation sensors 70A-70C to the movement of flag 74 are well known to those of ordinary skill in the art and are a matter of design choice.

It will be apparent to those skilled in the art that various modifications and variations can be made to the present invention without departing from the spirit and scope of the invention. For example, two pick tires are shown but the sensing mechanism can be used with a single pick tire configuration. Also the sensor can be a proximity sensor positioned adjacent to the end of the flag that contacts the surface of the media sheet being picked and changes state as the flag end raises and lowers during media sheet feeding. The sensor can also be a switch that is actuated by the flag. The flag can be connected to a potentiometer allow for continuous signal for tracking the position of the flag. Thus it is intended that the present invention cover the modifications and variations of this invention provided they come within the scope of the appended claims and their equivalents.

What is claimed is:

1. A media picking device for a media input tray of an image forming apparatus, the media picking device rotatable within the media input tray, the media picking device comprising:

a media pick mechanism having a rotatable pick member including a housing for picking a media sheet, the rotatable pick member including a pick shaft extending from the housing, the pick shaft having a pick tire on each end thereof for picking the media sheet, and a flag mounted on the housing adjacent to the pick shaft, the flag moveable between a first position and a second position when a leading edge and a trailing edge of the media sheet being picked passes by; and a media sensor mounted on the housing of the rotatable pick member adjacent a media sheet pick point, the media sensor having an output signal change upon sensing movement of the flag when the leading edge of the media sheet being picked passes by the flag, and having another output signal change upon sensing movement of the flag when the trailing edge of the media sheet being picked passes by the flag.

2. The media picking device of claim 1, wherein the media sensor is one of a photointerrupter, a proximity sensor, a potentiometer, and a switch.

3. The media picking device of claim 1, further comprising:

the media sensor having a photointerrupter including a pair of opposed arms and a light beam passing between the opposed arms; and the flag having a blocking member that enters between the opposed arms when the flag moves from the first position to the second position when the leading edge of the media sheet being picked passes by and exits the opposed arms when the flag moves from the second position to the first position when the trailing edge of the media sheet being picked passes by.

4. A media picking device for a media input tray of an image forming apparatus, the media picking device comprising:

an arm engaging a stack of media sheets in the media input tray by being rotatable into the media tray;

a pick shaft rotatably connected to one end of the arm;

a first pick tire rotatably disposed at a first end of the pick shaft and a second pick tire rotatably disposed at a second end of the pick shaft, the first and second pick tires contacting and picking a topmost media sheet in the media input tray; and a sensing mechanism comprising:

a photointerrupter disposed at one end of the arm, the photointerrupter including a pair of opposed arms and a light beam passing between the opposed arms; and a flag pivotable about the pick shaft, the flag moving from a first position to a second position when the leading edge of the media sheet being picked passes by and moving from the second position to the first position when the trailing edge of the media sheet being picked passes by, the flag having a first end for contacting the media sheet being picked and a blocking member at a second end, the blocking member of the flag entering and exiting the opposed arms as the flag moves between the first and second positions, wherein the sensing mechanism provides an output signal representative of the leading and trailing edges of the media sheet being picked as the flag moves from the first position to the second position and from the second position to the first position.

5. The media picking device of claim 4, wherein the blocking member of the flag interrupts the light beam at the first position when the first end of the flag is not in contact with the media sheet.

6. The media picking device of claim 4, wherein the blocking member of the flag allows the light beam to pass between the opposed arms at the second position when the first end of the flag is in contact with a leading edge of the media sheet.

7. The media picking device of claim 6, wherein the blocking member of the flag allows the light beam to pass between the opposed arms at the second position until the trailing edge of the media sheet clears the first end of the flag.

8. The media picking device of claim 4, wherein the blocking member of the flag is disposed between the pair of opposed arms to interrupt the light beam when in the first position.

9. The media picking device of claim 4, wherein the flag rotates through an angle of between about 20 to about 70 degrees when the leading edge of the media sheet contacts the first end of the flag.

10. The media picking device of claim 9, wherein the flag rotates through an angle of between about 40 to about 60 degrees when the leading edge of the media sheet contacts the first end of the flag.

11. A device to move media sheets within an image forming apparatus, the device comprising:

an arm rotatably driven from the image forming apparatus and positioned to engage a stack of media sheets in a media input tray;

a pick shaft rotatably connected to one end of the arm;

at least one pick tire mounted on the pick shaft for engaging a topmost media sheet in a stack of media sheets in a media input tray;

a sensing mechanism comprising a photointerrupter disposed on the arm, the photointerrupter having a light emitting element and a light receiving element and actuated by a light beam traveling from the light emitting element to the light receiving element; and a member mounted on the arm and pivotable about the pick shaft and interrupting the light beam when the member is not in contact with a media sheet being picked.

12. The device of claim 11, wherein the member has a first end and a second end, the second end including a blocking member to interrupt the light beam.

13. The device of claim 11, wherein the photointerrupter detects movement of the member occurring when the first end of the member contacts a leading edge and a trailing edge of the media sheet being picked.

14. The device of claim 11, wherein the member unblocks the light beam when the first end of the member contacts the leading edge of the media sheet being picked.

15. The device of claim 14, wherein the member unblocks the light beam until the trailing edge of the media sheet being picked clears the first end of the member.

16. The device of claim 11, wherein the member is positioned between the light emitting element and the light receiving element to interrupt the light beam when the member is not in contact with the media sheet.

17. The device of claim 11, wherein the member rotates through an angle of between about 20 to about 70 degrees when the leading edge of the media sheet contacts the first end of the member.

18. The device of claim 17, wherein the member rotates through an angle of between about 40 to about 60 degrees when the leading edge of the media sheet contacts the first end of the member.

* * * * *